US005810661A

United States Patent [19]

Bang

[11] Patent Number: 5,810,661

[45] Date of Patent: Sep. 22, 1998

[54] METHOD AND APPARATUS FOR CONTROLLING THE ORIENTATION OF ADJUSTABLE AIR FLOW DIRECTION BLADES OF AN AIR CONDITIONER

[75] Inventor: Yong-Woong Bang, Suwon, Rep. of Korea

[73] Assignee: Samsung Electronics Co., Ltd., Suwon, Rep. of Korea

[21] Appl. No.: 799,441

[22] Filed: Feb. 13, 1997

[30] Foreign Application Priority Data

Feb. 22, 1996 [KR] Rep. of Korea ..... 96-4225

[51] Int. Cl.[6] ..... F24F 13/15

[52] U.S. Cl. ..... 454/286; 454/229; 454/233; 454/256; 454/315

[58] Field of Search ..... 454/153, 321, 454/229, 230, 231, 233, 286, 313, 315, 256

[56] References Cited

U.S. PATENT DOCUMENTS 3,257,931 6/1966 Lupton ..... 454/285
5,242,325 9/1993 Nukushina ..... 454/285
5,660,588 8/1997 Kotoh et al. ..... 454/285

FOREIGN PATENT DOCUMENTS 62-123248 6/1987 Japan ..... 454/285
62-123249 6/1987 Japan ..... 454/285
63-204061 8/1988 Japan ..... 454/285

*Primary Examiner*—Harold Joyce
*Attorney, Agent, or Firm*—Burns, Doane, Swecker & Mathis, L.L.P.

[57] ABSTRACT

An air conditioner includes an air outlet for discharging temperature-conditioned air. Horizontal and vertical blades extend across the air outlet and are pivotably adjustable for controlling the up/down and right/left directions of air flow, respectively. The blades are pivotable by means of motors. A manually manipulable control panel enables a user to select between automatic and manual control over the positions of the blades. If automatic control is selected, then the horizontal and/or vertical blades are continuously pivoted within a predetermined angle. If manual control is selected, a target position for the horizontal and/or vertical blades is chosen, wherein a detector senses a current position of the blades and stops the motor(s) when the target position has been reached.

7 Claims, 4 Drawing Sheets

METHOD AND APPARATUS FOR CONTROLLING THE ORIENTATION OF ADJUSTABLE AIR FLOW DIRECTION BLADES OF AN AIR CONDITIONER

BACKGROUND OF THE INVENTION

1. Field of the Invention

The present invention relates to an air conditioner having air directing blades for adjusting the discharging directions of heat-exchanged air and, more particularly to an apparatus for controlling the flow direction of the air.

2. Description of the Prior Art

Generally, there is provided in an air conditioner, either a heating apparatus for thermally exchanging a cold room air with a warm air to be supplied to the room, or a cooling apparatus for thermally exchanging a warm air in the room with a cold air and for supplying the air back to the room.

An air conditioner having both heating and cooling functions is also available, and in addition an air conditioner further having a cleaning function of the contaminated room air is also provided.

FIG. 1 shows an indoor unit for a cooling/heating apparatus (generally called an air conditioner) having both functions of cooling and heating among the above enumerated ones in which the air conditioner also has an outdoor unit, although not illustrated.

A conventional air conditioner has, as shown in FIG. 1, a suction grille member 5 having suction inlets 3 for taking in a room air and provided at a front lower portion of a main body 1, and a discharge outlet 7 for discharging indoors the air heat-exchanged by a heat-exchanger with cold or warm air, the outlet disposed at a front upper portion of the body 1.

Horizontal and vertical blades 9, 11 are disposed in the discharge outlet 7 so that the discharging directions of the air through the discharge outlet 7 can be vertically and/or horizontally adjusted, respectively. The blades 9, 11 are driven by means of two motors, not illustrated, each of which is coupled to one set of blades 9, 11.

A cover member 13 attached to the front surface of the body 1 is used in protecting the interior of the body 1 and usually designed to give a good appearance thereto. In a lower area of the cover member 13 is disposed a manipulating panel 15 for setting desired operation modes of the air conditioner such as automatic mode, cooling, heating, defrost, air-cleaning, and so forth, and a start/stop of the air conditioner, for adjusting the amount or flow direction of the air discharged through the discharge outlet 7, and for displaying the operated states of the air conditioner.

For such a structured conventional air conditioner, if a user selects a desired operational mode through a remote controller or a manual manipulating panel 15 and then depresses a selected operation key, an indoor fan (not shown) is rotated such that the room air introduced into the body 1 through the suction inlet 3 is heat-exchanged by the evaporating latent heat of the refrigerant flowing in the heat-exchanger when the sucked air passes the heat-exchanger.

Vertical adjustment of the discharging direction of the conditioned air is achieved through an angular displacement of the blades 9 by one motor which is driven when a key for manipulating blades 9 on the panel 15 is repeatedly actuated until the blades 9 are in the desired position.

Similarly, horizontal adjustment of the discharging direction of the conditioned air is achieved through an angular displacement of the blades 11 by another motor driven when a key for manipulating the blades 11 on the panel 15 is repeatedly actuated until the blades 11 are in the desired position.

However, such an adjustment is accompanied with inconvenience for a user in defining the desired positions of each of blades 9, 11, for a user has to repeatedly operate the key until the blades are in the desired positions through a visual confirmation. Furthermore, the adjustment tends to be often done beyond a possible visibility necessary to visually confirm the currently set positions of the blades 9, 11, which limits the operational range.

SUMMARY OF THE INVENTION

Therefore, it is an object of the present invention to provide an adjusting apparatus of an air discharging direction for an air conditioner and a method therefor, by which the user can establish any desired position among predetermined discrete positions through a simplified key manipulation, the air blow blade air flow control blades can be moved toward the selected position, and the operation state is displayed such that the user can visually confirm the procedures.

The above objects are accomplished by an air flow adjusting apparatus for an air conditioner having a suction inlet for sucking a room air, a discharging outlet for discharging the air heat-exchanged by the indoor heat exchanger and air flow blades provided such that the discharging directions of the air through the discharge outlet can be horizontally and/or vertically adjusted, respectively, the apparatus comprising:

operational manipulating means provided for selecting any position of the air flow blades, the selected position being established by a user within an adjustable angle range;

means for driving the air flow blades such that the blades can be moved to the position selected through the operational manipulating means;

position detecting means for detecting a current position of the air flow blades;

A control means for controlling the driving means, based upon the moved position of the air flow blades detected by the position detecting means; and display means for displaying the moved position of the air flow blades selected by the operational manipulating means.

Furthermore, according to another aspect of the present invention, a method is provided for adjusting an air discharging direction for an air conditioner having a suction inlet for sucking a room air, a discharging outlet for discharging the air heat-exchanged by the indoor heat exchanger, and air flow blades provided such that the discharging directions of the air through the discharge outlet can be horizontally and/or vertically adjusted, respectively, the method comprising the steps of:

selecting either automatic or manual operation modes for the air flow blades through operational manipulating means and selecting any desired position of the air flow blades;

driving the air flow blades to move the air flow blades in compliance with the selected automatic or manual operation and position of the air flow blades;

detecting a current position of the resulting from the driving of the driving means; and displaying the operation state and moving position of the air flow blades selected by the user.

BRIEF DESCRIPTION OF THE DRAWINGS

Other objects and aspects of the invention become will become apparent from the following description of embodiments with reference to the accompanying drawings in which.

DETAILED DESCRIPTION OF THE PREFERRED EMBODIMENT

Figure 1:
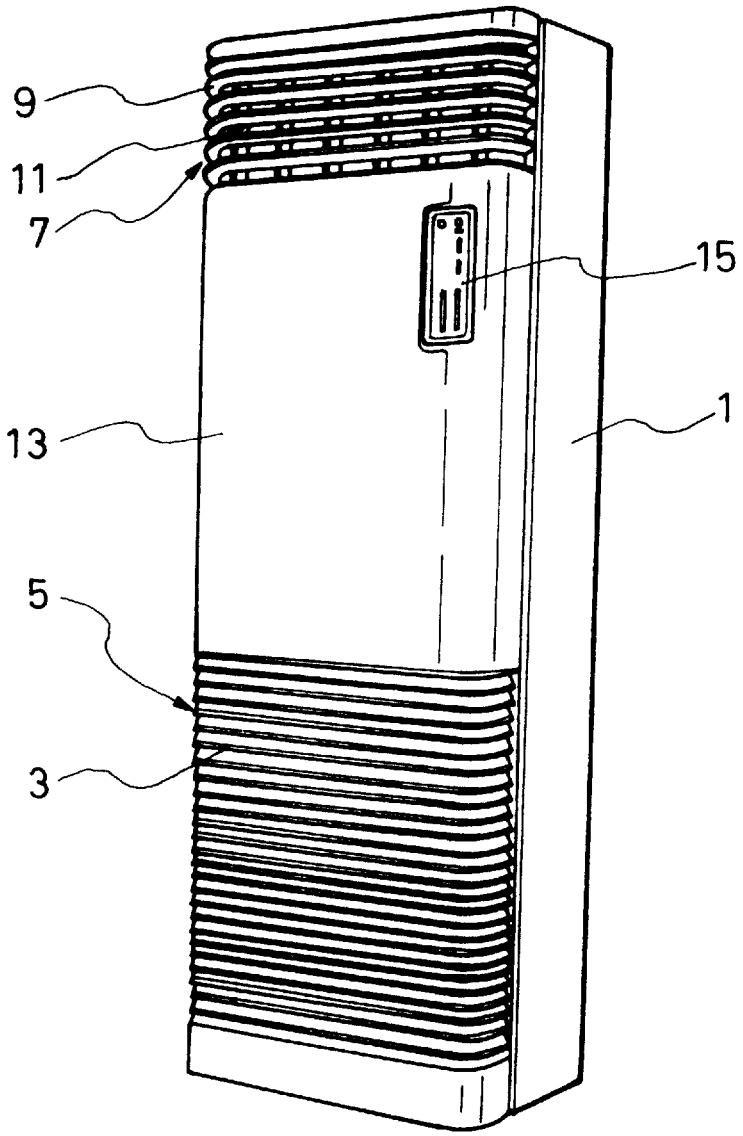
FIG. 1 (PRIOR ART)
FIG. 1 is a schematic perspective view illustrating an indoor unit of a conventional air conditioner.

The preferred embodiment according to the present invention will now be described in detail in accordance with the accompanying drawings.

Throughout the accompanying drawings, like parts are designated by like reference numerals or symbols.

Figure 2:
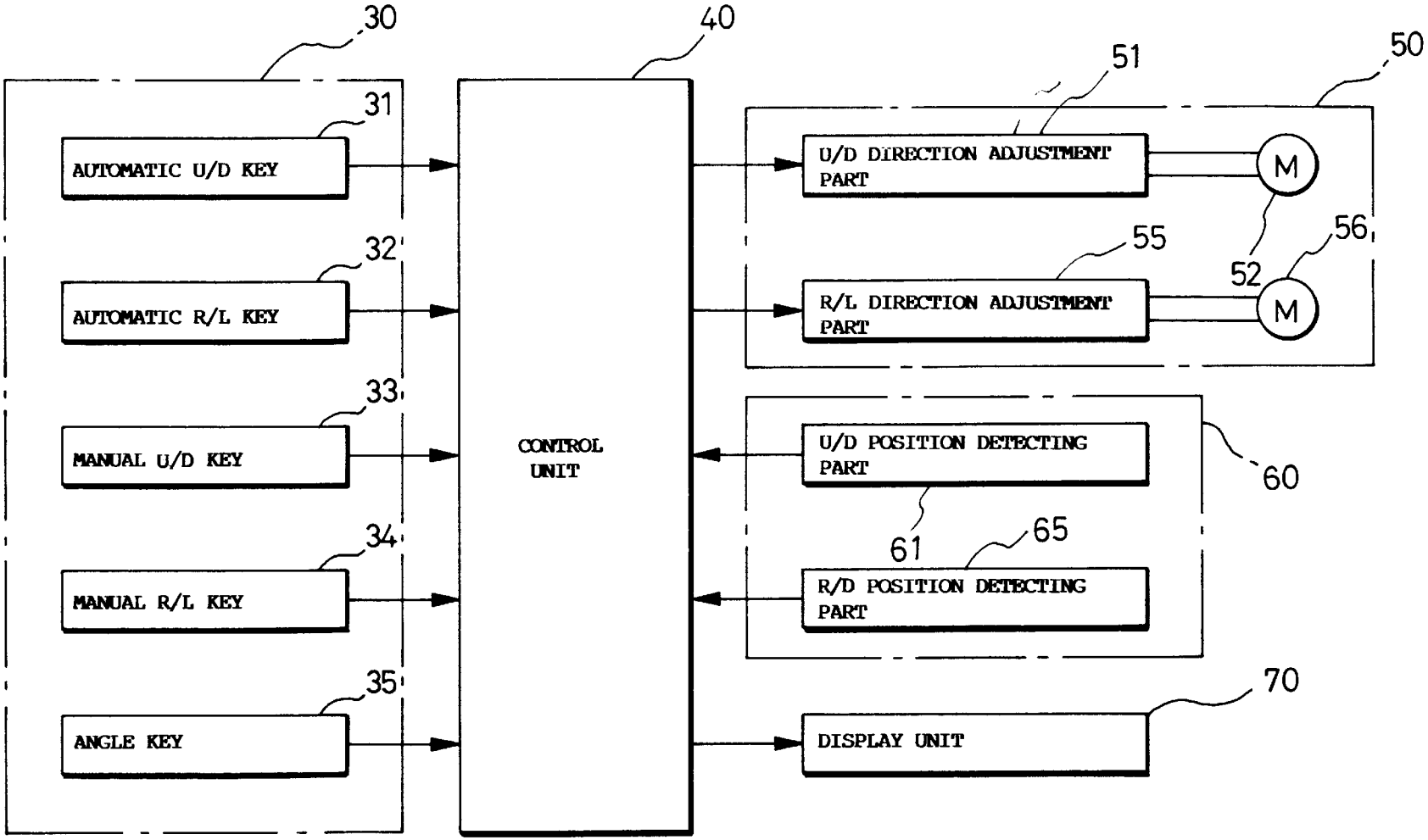
FIG. 2 is a control block diagram of an air flow direction adjustment apparatus for an air conditioner according to the present invention.

FIG. 2 shows operational manipulating means 30 including keys for selectively establishing the operational modes such as automatic mode, cooling, heating, defrost, air-cleaning, and so forth, of the air conditioner, a flow rate such as strong, weak, soft and so forth of air discharged through the discharge outlet 7, and the desired temperature Ts (hereinafter, referred to as a set temperature), as well as an operation key for a start/stop of the air conditioner. More specifically, the operational manipulating means 30 includes automatic U/D (Up/Down) key 31 for establishing a continued up/down swinging of horizontal blades 9 within the range of a predetermined adjustable angle, automatic R/L (Right/Left) key 32 for establishing a continued right/left swinging of vertical blades 11 within the range of a predetermined adjustable angle, manual U/D key 33 for designating a fixed position of blades 9 which a user desires, manual R/L key 34 for designating a fixed position of blades 11 which a user desires, and an angle key 35 for setting a target position of the blades which a user selects among predetermined discreet positions within the adjustable angle range (in case manual manipulation over the air flow direction is selected).

Control means 40, which may comprise a microprocessor, enables a user to adjust automatically or manually the discharging direction of the air passing through the discharge outlet 7 in response to the commands issued from the operational manipulating means 30, and controls the general operations of the air conditioner. This control means 40 outputs driving pulses used in controlling the development of the angle of the blades 9, 11.

Means 50 for adjusting the discharging direction is provided for physically moving upward or downward and left or right the blades 9, 11, respectively, under the control of the control means 40 in order to automatically or manually adjust the discharging direction of the conditioned air. The means 50 includes U/D blowing direction adjustment part 51 for driving stepping motor 52 (hereinafter, referred to as U/D direction driving motor) to cause blades 9 to be in a desired position in response to the control signal from the control means 40, and R/L blowing direction adjustment part 55 for driving stepping motor 56 (hereinafter, referred to as R/L direction driving motor) to cause blades 11 to be in a desired position in response to the control signal from the control means 40.

Position detecting means 60 adapted to detect the present positions of the blades 9, 11 and inform the results to the control means 40 includes U/D position detecting part 61 for detecting a current position of the blades 9 moved according to the driving of the U/D direction driving motor 52, and R/L position detecting part 65 for detecting a current position of the blades 11 moved according to the driving of the R/L direction driving motor 52.

Display means 70 displays, under the control of the control means 40, the selected operation selected mode (automatic mode, cooling, heating, defrost, air-cleaning, and so forth, of the air conditioner) applied to the operational manipulating means 30, the set temperature Ts and the room temperature Tr, as well as the displacement amount of the blades 9, 11.

It may be preferable to design the operational manipulating means 30 and display means 70 as a remote controller or a remocon that is able to remotely control the operations to the air conditioner.

Also, the current positions of the U/D and R/L blades 9, 11 can be recognized based upon the angles provided from the U/D and R/L position detecting parts 61, 65 which are compared with a reference value that can be utilized in determining the positions of the moved blades 9, 11. The reference value is defined as initial position of the U/D and R/L air 9, 11 at an initial operation, or in case of the manipulation of the respective keys for manual control to the flow direction.

The operation and advantages of such a structured apparatus according to the present invention and method therefor will be described.

Figure 3A:
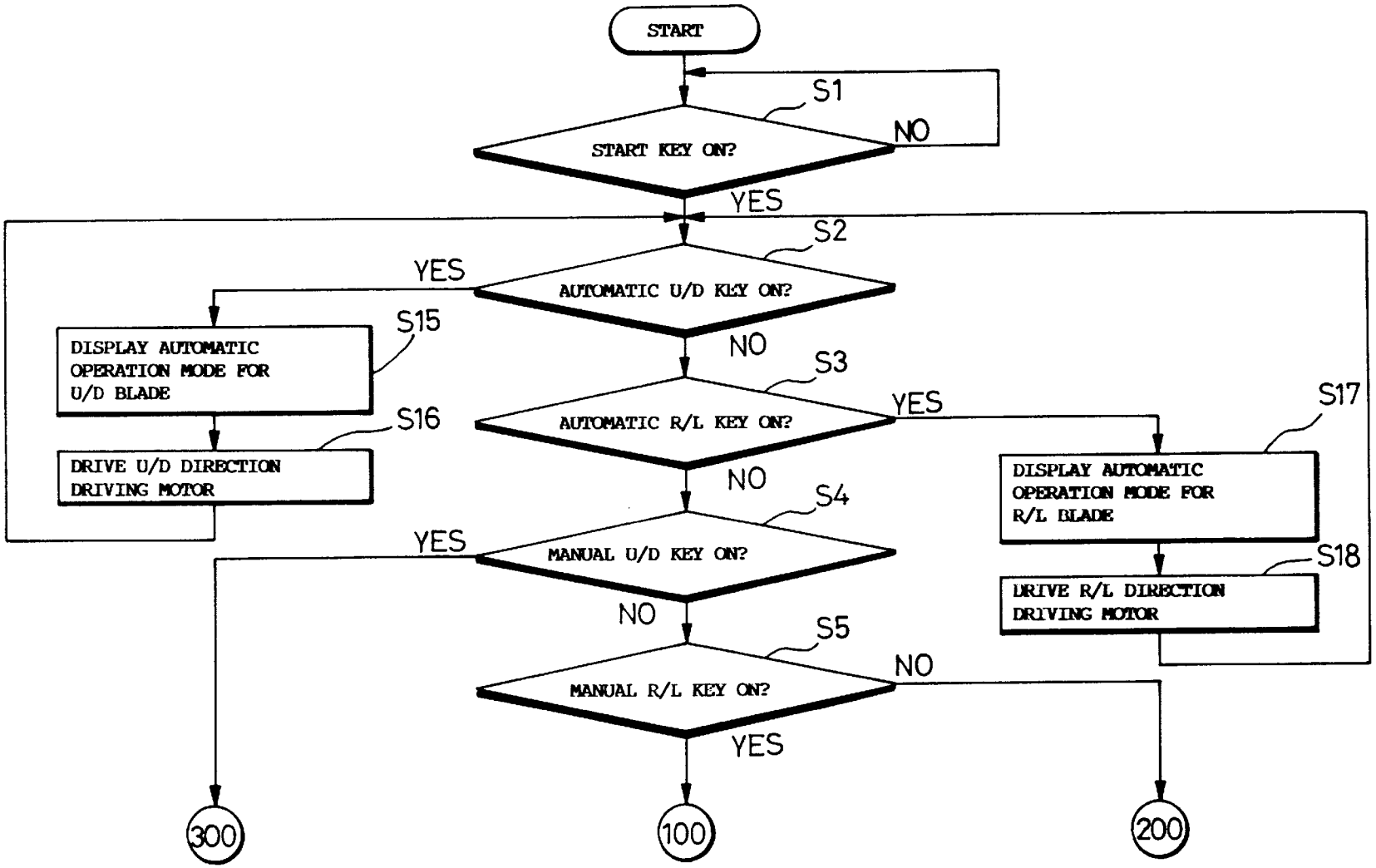
FIG. 3 is a flowchart illustrating the sequential process for controlling the air flow direction for the air conditioner according to the present invention.
Figure 3B:
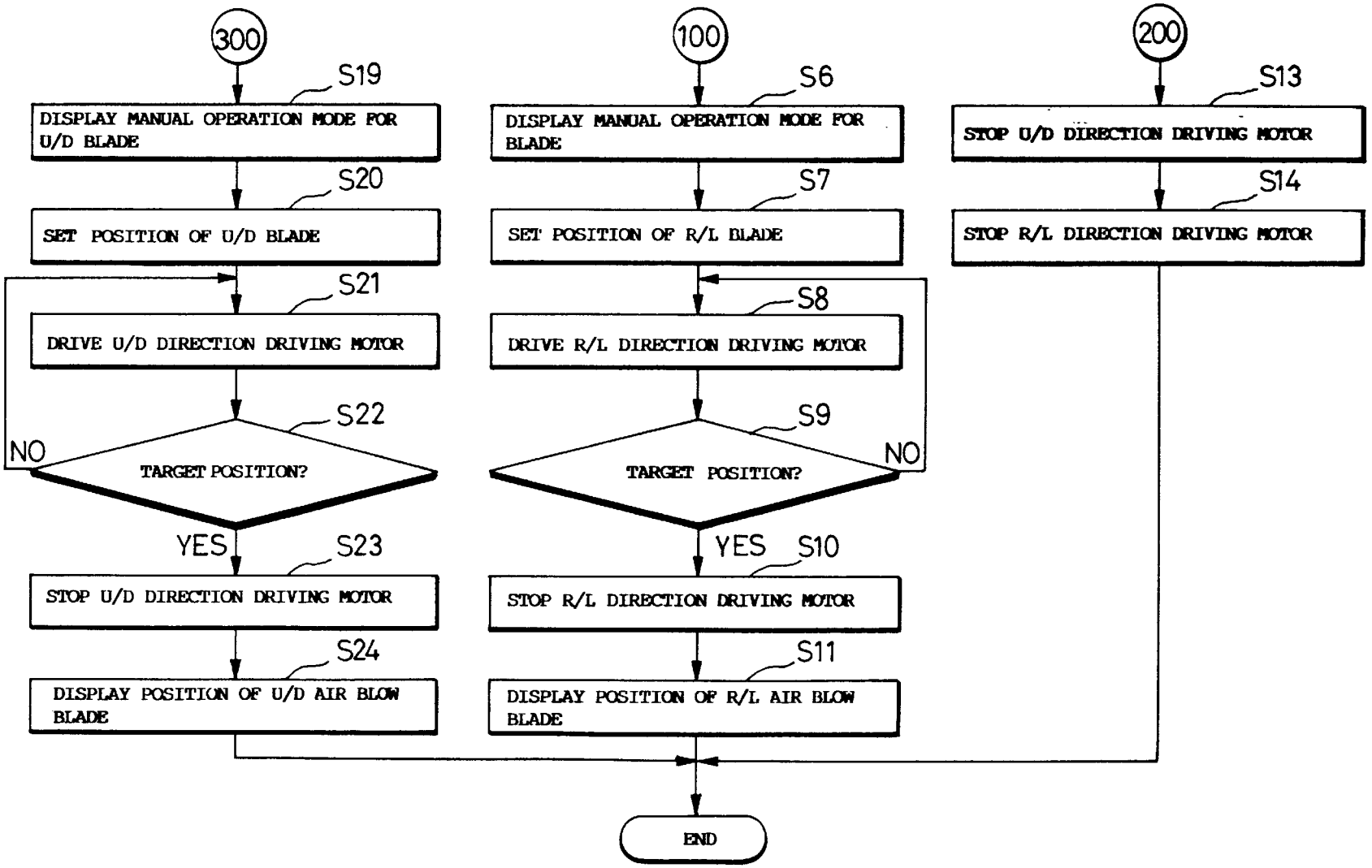

FIG. 3 is a flowchart illustrating sequential control procedures for adjusting discharging directions of the conditioned air.

Power supply means (not shown) supplies a DC voltage to the control means 40 that initializes the air conditioner when an electric power is applied to the air conditioner. After initializing, at step Si, the control means 104 determines whether the start key is selected or not. If not (in case of NO), the decision step S1 is repeated to maintain a standby of the air conditioner.

If the start key is selected (in case of Yes), the process advances to step S2 in which it is determined whether or not the automatic U/D key 31 on the operational manipulating means 30 is selected. This causes the blades 9 to be continuously and automatically swung, causing the conditioned air to be repeatedly directed upward and downward within the predetermined discharging range. In case the automatic U/D key 31 is not depressed (in case of NO), the process goes to step S3 where another decision is in turn made as to whether the automatic R/L key 32 on the operational manipulating means 30 is selected. This causes the blades 11 to be continuously and automatically swung, causing the conditioned air to be repeatedly directed left and right within the predetermined discharging range.

If the automatic R/L key 32 is not depressed (in case of NO), the process advances to step S4 where it is determined if the manual U/D key 33 on the operational manipulating means 30 is selected. This enables the user to establish a fixed position of blades 9 toward an area to which the user desires to discharge indoors the conditioned air. If the key 33 is not depressed (in case of NO), at step S5 to which the process advances accordingly, the subsequent decision is made whether the manual R/L key 34 on the operational manipulating means 30 is selected. This enables the user to establish a fixed position of horizontal blades 11 toward an area to which the user desires to discharge indoors the conditioned air.

If the R/L key 34 is selected (in case of YES), the process advances to step S6 where the control means 40 outputs the display control signal to the display means 70 that displays a manual operation mode of the R/L blades 11 such that the user can visually and readily know the selected air flow direction. At this same time, the R/L air discharging adjustment part 55 that receives the control signal from the control means 40 is operated to drive the R/L direction driving motor 56 so that the blades 11 return to an initial position. Then, the R/L position detecting part 65 has the value of zero that indicates that the part 65 is initialized and that the R/L blades 11 reached the extreme left end of the angle range adjustable.

Next, at step S7, a target position of the R/L blades 11 is set through the adjustment of the angle key 35 by the user. The user can establish any desired position among the discrete positions of, for example, fist, second and third positions having the range of 15-degree, 45-degree and 60-degree measured from the extreme left end. Advancing to step S8, the control means 40 then outputs the driving pulses to the R/L air discharging adjustment part 55 to drive the R/L direction driving motor 56 that cause the R/L blades 11 to travel to the target position that the user selected.

While the blades 11 are rotating to reach the target position, the angle of the R/L direction driving motor 56 is detected by the R/L position detecting part 65 that counts increments of rotation, wherein the counts are used in determining if the blades 11 reached the target position.

If the blades 11 have not yet reach the target position (in case of NO at step S9), the process returns to the previous step S8 in which the process repeats. In case the blades 11 reach the target position, the process advances to step S10 where the control means 56 stops the motor 56 through the R/L air discharging adjustment part 55. Next, at step S11, the control means 40 displays the current moved position of the R/L blades 11 through the display means 70, and finishes the air discharging direction adjustment procedures.

If the manual R/L key 34 is not depressed (in case of NO at step S5), the procedure goes to step S13 in which the U/D air discharging direction adjustment part 51 stops the U/D direction driving motor 52 under the control of the control means 40, and then advances to step S14. At step S14, the R/L air discharging direction adjustment part 55 stops the R/L direction driving motor 56 under the control of the control means 40, and the air discharging direction adjustment procedures are finished.

If the automatic U/D key 31 was depressed (in case of YES at step S2), the process advances to step S15 where the display means 70 receives a control signal from the control means 40 to display the automatic operation of the U/D blades 9 such that the user can visually confirm the selected air discharging state through the display means 70. At the subsequent step S16, the control means 40 outputs the driving pulses for operating the U/D direction driving motor 52 to the U/D air discharging direction adjustment part 51 such that the U/D blades 9 continue to swing up/down.

Accordingly, the U/D air discharging adjustment part 51 receives the driving pulses output from the control means 40 and repeatedly drives the U/D direction driving motor 52 in alternately forward and backward directions that causes the U/D blades 9 to be correspondingly moved within the adjustable angle range. The process returns to step S2 and then repeats the subsequent steps.

If the automatic R/L key 32 was depressed (in case of YES at step S3), the process advances to step S17. At step S17, the display means 70 receives the control signal from the control means 40 to display the current automatic operation. Next, at step S18, the control means 40 outputs the driving pulses for operating the R/L direction driving motor 11 to the R/L air discharging direction adjustment part 55 such that the R/L blades 11 can continue to swing right/left.

Accordingly, the R/L air discharging adjustment part 55 receives the driving pulses output from the control means 40 and repeatedly drives the R/L direction driving motor 56 alternately in forward or backward directions that causes the R/L blades 11 to be correspondingly moved within the adjustable angle range. The process returns to step S2 and then repeats the subsequent steps.

If the manual U/D key 33 is selected (in case of YES at step S4), the process advances to step S19 where the control means 40 outputs the display control signal to the display means 70 that displays manual operation mode of the U/D blades 9 such that the user can visually and readily know the selected air flow state. At this same time, the U/D air discharging direction adjustment part 51 that receives the control signal from the control means 40 is operated to drive the U/D direction driving motor 52 so that the U/D blades 9 can return to an initial position. Then, the U/D position detecting part 61 has the value of zero that indicates that the part 61 is initialized and that the U/D blades 9 reached the extreme bottom of the adjustable vertical angle range.

Next, at step S20, a target position of the U/D blades 9 is set through the adjustment of the angle key 35 by the user. The user can establish any desired target position among the discrete positions of, for example, first, second and third positions having the range of 15-degree, 45-degree and 60-degree measured from the extreme bottom end, within an adjustable angle range. Advancing to step S21, the control means 40 then outputs the driving pulses to the U/D air discharging direction adjustment part 51 to drive the U/D direction driving motor 52 that causes the U/D blades 9 to travel to the target position that the user selected.

While the blades 9 are rotating to reach the target position, the angle of the U/D direction driving motor 52 is detected by the U/D position detecting part 61 that counts increments of rotation wherein the counts are used in determining if the blades 9 reached the target position.

If the blades 9 have not yet reach the target position (in case of NO at step S22), the process returns to the previous step S21 in which the process then repeats. In case the blades 9 reached the target position, the process advances to step S23 where the control means 40 stops the motor 56 through the U/D air discharging direction adjustment part 51. Next, at step S24, the control means 40 displays the current moved position of the U/D blades 9 through the display means 70, and finishes the air discharging direction adjustment procedures.

According to the apparatus and method of the present invention, the user can establish any desired position among the predetermined discrete positions through the simplified key manipulation, the air flow blades can be moved toward the selected position, and the operation states are displayed such that the user can visually confirm the procedures.

I claim:

1. In an air conditioner comprising a body having an air inlet, an air blower, a heat exchanger for changing a temperature of air entering through the air inlet, an air outlet for discharge the temperature-changed air, air flow directing blades pivotably mounted at the air outlet for adjusting a flow direction of discharged air, a motor arrangement for pivoting the blades, and a control mechanism for controlling the motor, the improvement wherein the control mechanism comprises:

manual manipulation means for selection of a blade target position within an angle of rotation, the motor arrangement being actuated in response to the selection of a target position to pivot the blades;

a position detector for detecting a current blade position and providing a signal;

a controller connected to the motor for stopping the motor when the signal received from the detector indicates that the current blade position corresponds to the target position; and a display for displaying the target position of the blades when the blades reach the target position.

2. The air conditioner according to claim 1 wherein the blades include vertical blades for determining a horizontal air flow direction and horizontal blades for determining a vertical air flow direction, the motor arrangement comprising motors connected to the vertical and horizontal blades, respectively.

3. The air conditioner according to claim 2 wherein the manipulating means includes a manual up/down key for selecting a manual control over the motor associated with the horizontal blades, a manual right/left key for selecting a manual control over the motor associated with the vertical blades, and an angle key for selecting an angle of blades selected for adjustment by actuation of the manual up/down key or the manual right/left key.

4. The air conditioner according to claim 1 wherein the motor is a stepping motor, and the detector is operable to count increments of rotation of the motor.

5. A method of adjusting a discharge direction of air from an air outlet of an air conditioner, the air conditioner including pivotable blades for changing the discharge direction, and a motor arrangement for pivoting the blades, the method comprising the steps of:

A) manually selecting between automatic and manual control of the blades;

B) actuating the motor arrangement for continuously pivoting the blades when automatic control is selected in step A;

C) manually determining a target position of adjustment for the blades when manual control is selected in step A;

D) automatically actuating the motor arrangement and repeatedly detecting a current position of the blades when manual control is selected in step A;

E) automatically displaying the selected type of blade control; and

F) automatically comparing a current position of the blades with the target position and deactivating the motor arrangement when the current position coincides with the target position, and displaying the target position.

6. In an air conditioner comprising a body having an air inlet, an air blower, a heat exchanger for changing a temperature of air entering through the air inlet, an air outlet for discharge the temperature-changed air, air flow directing blades pivotably mounted at the air outlet for adjusting a flow direction of discharged air, a motor arrangement for pivoting the blades, and a control mechanism for controlling the motor, the improvement wherein the control mechanism comprises:

manual manipulation means for selection of a blade target position within an angle of rotation, the motor arrangement being actuated in response to the selection of a target position to pivot the blades;

a position detector for detecting a current blade position and providing a signal;

a controller connected to the motor for stopping the motor when the signal received from the detector indicates that the current blade position corresponds to the target position; and a display for displaying the target position of the blades;

wherein the manipulation means includes a manual up/down key for selecting a manual control over the motor associated with the horizontal blades, a manual right/left key for selecting a manual control over a motor associated with the vertical blades, and an angle key for selecting an angle of blades selected for adjustment by actuation of the manual up/down key or the manual right/left key.

7. The air conditioner according to claim 6 wherein the manipulating means further comprises an automatic up/down key for causing the horizontal blades to continuously pivot up and down in a predetermined pivot range, and an automatic right/left key for causing the vertical blades to continuously pivot right and left in a predetermined pivot range.

* * * * *